US005163590A

United States Patent [19]

Lawler et al.

[11] Patent Number: 5,163,590

[45] Date of Patent: Nov. 17, 1992

[54] SPECIALIZED AQUATIC GEAR HANGER

[76] Inventors: William M. Lawler, 2037 Miramar Walk, Oxnard, Calif. 93035; Raul J. Jaquez, 4803 Solsitio, Oceanside, Calif. 92056

[21] Appl. No.: 787,125

[22] Filed: Nov. 4, 1991

[51] Int. Cl.[5] ..... A47G 25/28; A47G 25/14

[52] U.S. Cl. ..... 223/88; 223/85; 223/69

[58] Field of Search ..... 223/88, 85, 92, 95, 223/69; 211/113; D6/315, 327

[56] References Cited

U.S. PATENT DOCUMENTS

| | | | |
|---|---|---|---|
| D. 162,261 | 2/1951 | Tuma | D6/317 |
| D. 164,710 | 10/1951 | Perry | D6/319 |
| D. 204,342 | 4/1966 | Larkin | D6/316 |
| 1,295,094 | 2/1919 | Ackermann | 223/88 |
| 1,309,983 | 7/1919 | Golar | 223/88 |
| 1,619,992 | 3/1927 | Smith | 223/88 |
| 2,025,114 | 12/1935 | Legus | 223/88 |
| 2,129,871 | 9/1938 | Reed | 223/88 |
| 2,425,829 | 8/1947 | Rosenberg | 223/88 |
| 2,499,538 | 3/1950 | Stanton | 223/88 |
| 2,544,886 | 3/1951 | Kuhn | 223/88 |
| 2,576,612 | 11/1951 | Latvala | 223/88 |
| 2,813,666 | 11/1957 | Gray | 223/88 |
| 3,002,662 | 10/1961 | Albright | 223/95 |
| 3,036,748 | 5/1962 | Babkes | 223/88 |
| 3,517,823 | 6/1970 | Papineau | 223/88 X |
| 3,651,999 | 3/1972 | Fiocca | 223/88 |
| 3,963,154 | 6/1976 | Schwartz et al. | 223/85 |
| 4,978,043 | 12/1990 | Uke | 223/88 |
| 5,018,650 | 5/1991 | Mauffette | 223/93 |
| 5,038,979 | 8/1991 | Traylor | 223/88 |
| 5,054,666 | 10/1991 | Blanchard | 223/85 X |
| 5,056,693 | 10/1991 | DeBoe | 223/88 |

FOREIGN PATENT DOCUMENTS

| | | | |
|---|---|---|---|
| 723659 | 2/1955 | United Kingdom | 223/90 |
| 2180446 | 4/1987 | United Kingdom | 223/85 |
| 2235244 | 2/1991 | United Kingdom | 223/85 |

*Primary Examiner*—Werner H. Schroeder
*Assistant Examiner*—Bibhu Mohanty
*Attorney, Agent, or Firm*—Thomas I. Rozsa

[57] ABSTRACT

The present invention is a specialized aquatic gear hanger comprising a detachable swivel hook and a multiple plane hanger frame which has two parallel vertical panels connected at their upper ends by a horizontal bridge member. The first vertical plane has an aquatic sport suit retaining member for retaining an aquatic sport suit such as a wetsuit or a drysuit. The second vertical panel has a central vertical beam and a lower horizontal beam, two aquatic sport glove retaining members upwardly and outwardly extending respectively from the two lateral ends of the lower horizontal beam for retaining aquatic sport gloves, two aquatic sport boot retaining members upwardly then outwardly extending respectively from the lower horizontal beam between the central vertical beam and the two aquatic sport glove retaining members for retaining aquatic sport booties, and an aquatic sport utility article retaining member extending below the lower horizontal beam for retaining aquatic sport utility articles such as a hood, a mask, fins, towels and other accessories. The present invention specialized aquatic sport gear hanger is preferably made of molded polypropylene material.

27 Claims, 2 Drawing Sheets

FIG. 1
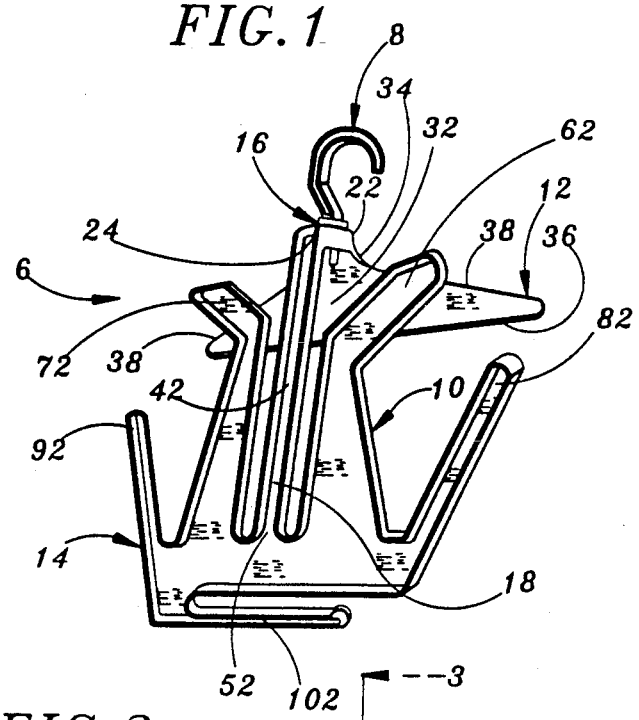
FIG. 4
(Section on line 4 - 4)
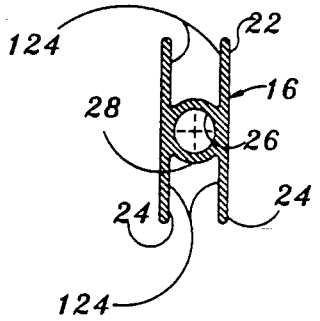
FIG. 2
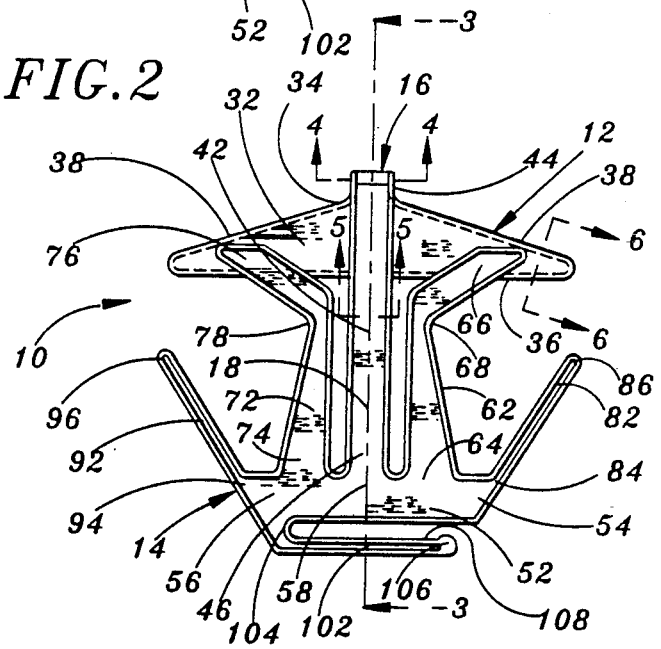
FIG. 3
(Section on line 3 - 3)
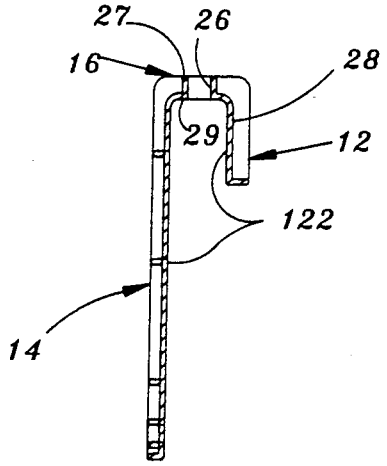
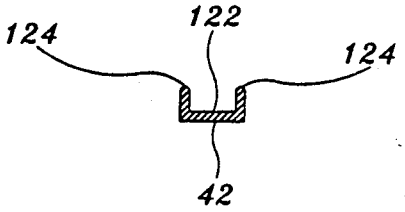
FIG. 5
(Section on line 5 - 5)
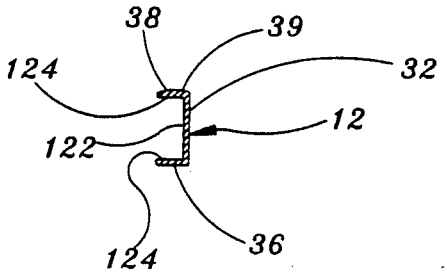
FIG. 6
(Section on line 6 - 6)

FIG. 7
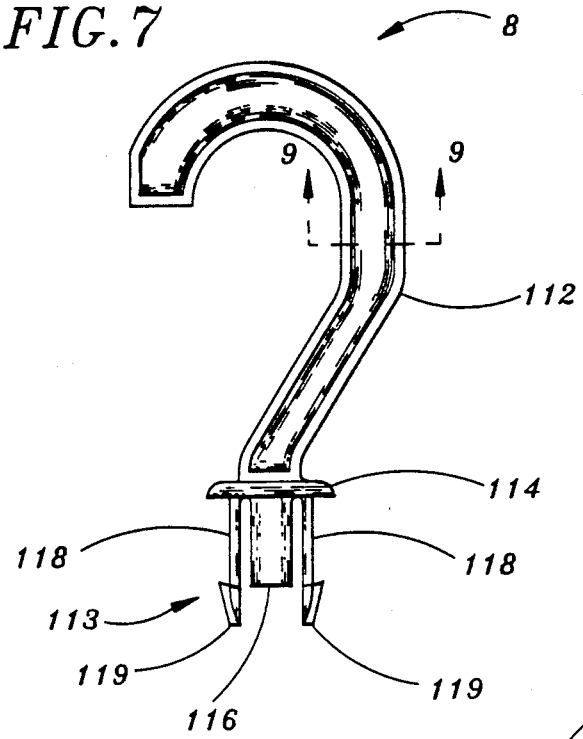
FIG. 8
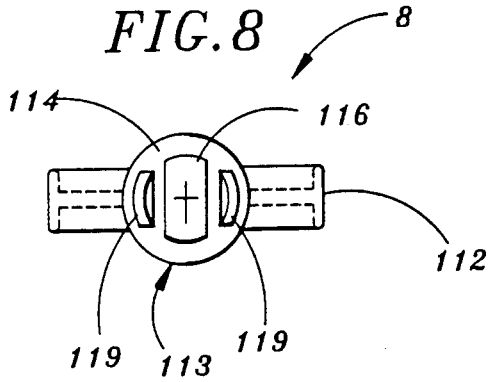
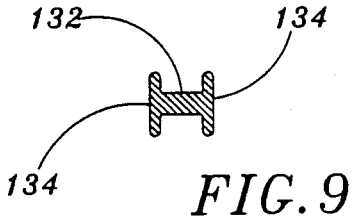
FIG. 9
(Section on line 9 - 9)
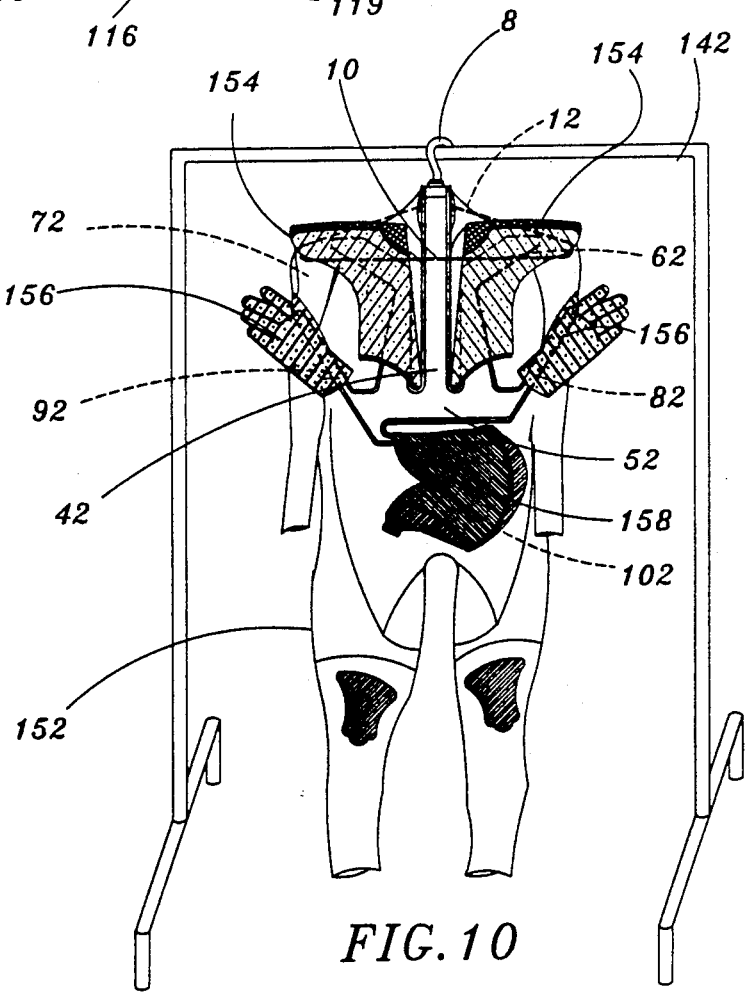
FIG. 10

SPECIALIZED AQUATIC GEAR HANGER

BACKGROUND OF THE INVENTION

1. Field of the Invention

The present invention relates to the field of garment hangers. More particularly the present invention relates to the field of specialized garment hangers for hanging sports gear.

2. Description of the Prior Art

Garment hangers are old in the art. Over the years many different types of garment hangers have been designed and constructed. The following is a list of pertinent prior art patents in this field.

1. U.S. Pat. No. Des. D204,342 issued to Larkin on Apr. 5, 1966 for "Haberdashery Hanger" (hereafter the "Larkin Design Patent").
2. U.S. Pat. No. Des. D164,710 issued to Perry on Oct. 2, 1951 for "Garment Hanger" (hereafter the "Perry Design Patent").
3. U.S. Pat. No. Des. D162,261 issued to Tuma on Feb. 27, 1951 for "Garment Hanger" (hereafter the "Tuma Design Patent").
4. U.S. Pat. No. 5,018,650 issued to Mauffette on May 28, 1991 for "Tamper Proof Hanger With Interchangeable Shoulder Cups" (hereafter the "Mauffette Patent").
5. U.S. Pat. No. 4,978,043 issued to Uke on Dec. 18, 1990 for "Hanger For Wetsuit Accessories And The Like" (hereafter the "Uke Patent").
6. U.S. Pat. No. 3,963,154 issued to Schwartz et al. on Jun. 15, 1976 for "Garment Hanger Construction" (hereafter the "Schwartz Patent").
7. U.S. Pat. No. 3,036,748 issued to Babkes on May 29, 1962 for "Auxiliary Garment Support" (hereafter the "Babkes Patent").
8. U.S. Pat. No. 3,002,662 issued to Albright on Oct. 3, 1961 for "Clothes Hanger" (hereafter the "Albright Patent").
9. U.S. Pat. No. 2,813,666 issued to Gray on Nov. 19, 1957 for "Garment Hanger" (hereafter the "Gray Patent").
10. U.S. Pat. No. 2,576,612 issued to Latvala on Nov. 27, 1951 for "Clothes Hanger" (hereafter the "Latvala Patent").
11. U.S. Pat. No. 2,544,886 issued to Kuhn on Mar. 13, 1951 for "Garment Hanger" (hereafter the "Kuhn Patent").
12. U.S. Pat. No. 2,499,538 issued to Stanton on Mar. 7, 1950 for "Garment Hanger" (hereafter the "Stanton Patent").
13. U.S. Pat. No. 2,425,829 issued to Rosenberg on Aug. 19, 1947 for "Garment Hanger" (hereafter the "Rosenberg Patent").
14. U.S. Pat. No. 2,129,871 issued to Reed on Sep. 13, 1938 for "Garment Hanger" (hereafter the "Reed Patent").
15. U.S. Pat. No. 2,025,114 issued to Legus on Dec. 24, 1935 for "Garment Hanger" (hereafter the "Legus Patent").
16. U.S. Pat. No. 1,619,992 issued to Smith on Mar. 8, 1927 for "Garment Hanger" (hereafter the "Smith Patent").
17. U.S. Pat. No. 1,309,983 issued to Golar on Jul. 15, 1919 for "Garment Supporter" (hereafter the "Golar Patent").

18. U.S. Pat. No. 1,295,094 issued to Ackermann on Feb. 25, 1919 for "Garment Support" (hereafter the "Ackermann Patent").

The three design patents disclose three different designs for garment hangers. The Tuma Design Patent discloses a three-level garment hanger, the Perry Design Patent discloses a garment hanger having three lateral hooks at each side, and the Larkin Design Patent discloses a shield shaped haberdashery hanger.

The Mauffette Patent discloses a tamper-proof garment hanger having gripping arms slidably and lockably attached with hanger arms. The gripping arms are provided with interchangeable shoulder cups. The gripping arms can be slid down and locked to make the top hook a closed loop so that the hanger may not be removed from a hanging bar.

The Uke patent discloses a hanger 10 designed for holding water sports accessories. The Uke patent hanger 10 is a unitary piece having a hook 12 integrally formed with an elongated neck 14. The elongated neck 14 further connects with a horizontal crossbar 16, which in turn supports two outer fingers 18 and 20 for holding diving booties, two inner fingers 22 and 24 for holding diving gloves, and a curved bottom member 26 for holding a diving hood. The disadvantage of the Uke patent is that first, it has no means for hanging a wetsuit; second, the two outer fingers 18 and 20 for hanging booties are bending inwardly which makes it very difficult to place the booties on or remove the booties from the outer fingers 18 and 20, and further crimples the booties when they are hung on the outer fingers; and third, when the gloves and booties are all hung on the Uke hanger 10, there is very little space left in between, which greatly reduces the effect of drying.

The Schwartz patent discloses a hook member 11 for a hanger. The hook member 11 has an elongated shank portion 12. The shank portion 12 comprises two oppositely projecting flanges 14 that are adapted to be collapsibly flexed toward each other when the elongated shank portion 12 is inserted into a vertical hole 21 on the top of a hanger 20. Annular steps 22 are provided on the sidewall of the vertical hole 21 for allowing the projecting flanges 14 to engage therein.

The Babkes patent discloses an auxiliary wire frame which can be attached and used together with a wire hanger. The auxiliary wire frame may expand to a crisscross structure for additional retaining facilities.

The Albright patent discloses a hanger having a telescoping tubing structure. It also has a hook member 25 having an elongated shank portion 31 rotatably attached to the telescoping tubes 11 and 12 of an adjustable hanger 10 and retained therein by a plug 26, which is in turn inserted inside the telescoping tubes 11 and 12.

The Gray Patent discloses a garment hanger having two additional press-on hook-like retainers. Each press-on hook-like retainers has two slots for snap-in engagement with a wire frame hanger.

The Latvala Patent discloses a clothes hanger having multiple horizontal beams for holding a multiplicity of flat garments. The multiple horizontal beams are all positioned in parallel next to one another.

The Kuhn patent discloses a garment hanger 1 for hanging a football suit and hooking football trousers. It comprises a spreader 1, a spacer plate 5 and a conventional hanger 7. It further comprises a top hook 6 fixedly mounted on the spacer plate 5. The conventional hanger 7 is generally triangular shaped for holding the football suit. The spreader 1 has many hook-like members 2, 3, and 4 for hooking the football trousers. The hanger is made of metal material.

The Stanton patent discloses a garment hanger having multiple suspension members for holding a coat, a trousers and a vest separately on a same hanger. The multiplicity of suspension members are all aligned in a same plane.

The Rosenberg patent discloses a garment hanger having two inwardly disposed horizontal bottom beams which have spaced notches for preventing the garment from sliding. The straps of a garment may be retained by the notches for hanging the garment.

The Reed patent discloses a generally triangular shaped garment hanger. Each of the two opposite inclined upper edges of the hanger has a re-entrance for retaining shoulder straps of a dress.

The Legus patent discloses a garment hanger having two wire hooks whose locations may be adjusted along a horizontal wire. The horizontal wire is shaped with many teeth shaped steps for fixing the position of the wire hooks.

The Smith patent discloses a garment hanger having an upper part and a lower part. The upper part has two oppositely extended arms for hanging a coat. The lower part has two inwardly disposed horizontal bottom beams for hanging additional flat garments.

The Golar patent discloses a garment hanger having a single wire frame structure. In addition to a regular hanger portion, the wire frame also forms a wire basket for holding a hat.

The Ackermann patent discloses a garment hanger having detachable and slidable hooks. The hooks are attached upon the horizontal beam of the hanger for retaining trousers.

Although a great number of prior art hangers have been disclosed by the prior art patents discussed above, none of them satisfies the need for hanging a whole set of aquatic gear altogether in a spaced apart relationship. A whole set of aquatic gear used by people in water related sports, such as diving, surfing, water skiing and board sailing, includes typically a wetsuit or a drysuit, a pair of gloves, a pair of booties and a hood. The heaviest piece is the suit.

The purpose of having the whole set hung up in a spaced apart relationship is to let them drip and dry as fast as possible while maintaining their forms. Although one hanger may be used to hang a wetsuit and another separate hanger may be used to hang the accessories, it is desirable to use a single hanger upon which such a complete set of aquatic gear can be hung in a spaced apart relationship. Having the whole set of aquatic gear hung together provides a great convenience to the user for carrying and hanging. It also helps to keep a complete set of aquatic gear together. This is particularly helpful in places such as retail shops and storage rooms, where it is highly desirable to keep each individual set of aquatic gear together.

SUMMARY OF THE INVENTION

The present invention is a specialized aquatic gear hanger for aquatic sports such as diving, surfing, water skiing and board sailing. The primary object of the present invention is to provide a hanger upon which a whole set of aquatic gear, including an aquatic sport suit, such as a wetsuit or a drysuit, and aquatic sport gloves, aquatic sport booties and aquatic sport utility articles, such as a hood, a mask, fins, towels and other accessories, can be all hung together in spaced apart relationship for various purposes, such as quick drying, compact storage, easy identification and convenient carriage.

The novel feature of the present invention specialized aquatic gear hanger is that it comprises a multiple plane hanger frame having two parallel vertical panels connected at their upper ends by a horizontal bridge member. The first vertical panel has a generally triangular shaped aquatic sport suit retaining member for retaining a heavy aquatic sport suit such as a wetsuit or a drysuit. The second panel has a central vertical beam and a lower horizontal beam forming a generally reversed T-shaped central support structure, two aquatic sport glove retaining members upwardly and outwardly extended from the two lateral ends of the lower horizontal beam respectively for retaining aquatic sport gloves, two generally reversed L-shaped aquatic sport boot retaining members upwardly then outwardly extended from the lower horizontal beam between the central vertical beam and the two aquatic sport glove retaining members respectively for retaining aquatic sport booties, and an aquatic sport utility article retaining member backwardly extended from one end of the lower horizontal beam and positioned parallel and below the lower horizontal beam for retaining aquatic sport utility articles such as a hood, a mask, fins, towels and other accessories.

The present invention specialized aquatic gear hanger further comprises a detachable swivel hook having an upper hook member and a lower shank member. The lower shank member has means for detachable and rotatable attachment to the horizontal bridge member of the multiple plane hanger frame, such that when the specialized hanger is hung, its multiple plane hanger frame is free to rotate relative to its swivel hook.

It is also an object of the present invention to design a specialized aquatic gear hanger which provides a unique arrangement of the hanging positions of the accessories of the aquatic gear. Particularly, the hanging positions of the aquatic sport booties are arranged to be as close to the central vertical beam as possible because they are much heavier than the aquatic sport gloves, while still have enough space left between the accessories of the aquatic gear to allow more air to go through for quick drying.

It is a further object of the present invention to design a specialized aquatic gear hanger which provides a unique fitting for hanging the accessories of the aquatic gear. Particularly, the reversed L-shaped aquatic sport boot retaining members are shaped at angles in such a unique way that the aquatic sport booties are not going to be crimpled when being retained there, and are easier to put on or take off from the aquatic sport boot retaining members It is an additional object of the present invention to construct a specialized aquatic gear hanger which has a channel structure to reinforce the strength of its branching members. Since a complete set of aquatic sport gear is very heavy when it is wet, the hanger frame must be very strong to withstand the weight of the whole set.

It is again an object of the present invention to provide a specialized aquatic gear hanger made of non-absorptive, noncorrosive and environmentally safe material.

It is an additional object of the present invention to provide a specialized aquatic gear hanger made of strong and durable, yet light weight material.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention specialized aquatic gear hanger.

FIG. 2 is a front elevational view of the present invention specialized aquatic gear hanger.

FIG. 3 is a cross-sectional view taken along line 3—3 of FIG. 2.

FIG. 4 is a cross-sectional view taken along line 4—4 of FIG. 2.

FIG. 5 is a cross-sectional view taken along line 5—5 of FIG. 2.

FIG. 6 is a cross-sectional view taken along line 6—6 of FIG. 2.

FIG. 7 is a front elevational view of the detachable swivel hook of the present invention specialized aquatic gear hanger.

FIG. 8 is a bottom plan view of the detachable swivel hook of the present invention specialized aquatic gear hanger.

FIG. 9 is a cross-sectional view taken along line 9—9 of FIG. 7.

FIG. 10 is a perspective view showing that a whole set of aquatic sport gear is retained by the present invention specialized hanger.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is shown at 6 the present invention specialized aquatic gear hanger. The present invention specialized aquatic gear hanger 6 comprises a hook 8 and a multiple plane hanger frame 10. The hook 8 is detachably and rotatably attached with the multiple plane hanger frame 10. The present invention specialized aquatic gear hanger 6 may be suspended by hanging the hook 8 onto a heightened horizontal bar or like object. As the hook 8 is latched into the heightened horizontal bar, the multiple plane hanger frame 10 is free to rotate about a vertical axis.

Referring to FIGS. 1 through 6, the multiple plane hanger frame 10 has two parallel vertical panels 12 and 14 connected at their upper ends by a horizontal bridge member 16. The horizontal bridge member 16 is a generally rectangular shape piece having a first end 22, a second end 24 and a central aperture 26. The central aperture 26 of the horizontal bridge member 16 is formed by a cylindrical sidewall 28 which has an upper circular rim 27 and a lower circular rim 29. The horizontal bridge member 16 has a channel structure which has a generally U-shaped cross-section. The channel structure has a flat bottom 122 and two side rails 124. The cylindrical sidewall 28 is integrally formed with and positioned between the two side rails 124. By way of example only, the length of the horizontal bridge member 16 from its first end 22 to its second end 24 is approximately $4\frac{1}{4}$ inches, the width of the horizontal bridge member 16 is approximately 2 inches, and the height of the horizontal bridge member 16, which is also the height of the two side rails 124 of the U-shaped channel structure, is approximately 1 inch. The thickness of the flat bottom 122 and the two side rails 124 of the U-shaped channel structure are all approximately $\frac{1}{4}$ inch, the thickness of the cylindrical sidewall 28 of the central aperture 26 is also approximately $\frac{1}{4}$ inch, and the diameter of the central aperture 26 is approximately 1 inch.

The first vertical panel 12 is connected to the first end 22 of the horizontal bridge member 16, and the second vertical panel 14 is connected to the second end 24 of the horizontal bridge member 16. The first vertical panel 12 and the second vertical panel 14 are parallel to each other. By way of example only, the distance between the first vertical panel 12 and the second vertical panel 14 is approximately $2\frac{1}{2}$ inches.

The first vertical panel 12 of multiple plane hanger frame 10 has a generally triangular shaped aquatic sport suit retaining member 32 for retaining an aquatic sport suit such as a wetsuit or a drysuit. It has a tapered upper end 34, a widened lower edge 36, and two inclined shoulder edges 38. The tapered upper end 34 of the triangular shaped aquatic sport suit retaining member 32 is integrally formed with and connected to the first end 22 of the horizontal bridge member 16, where the channel structure is also extended from the horizontal bridge member 16 to the first vertical panel 12. The flat bottom 122 of the U-shaped channel structure extends from the horizontal bridge member 16 to the first vertical panel 12 and forms the triangular shaped aquatic sport suit retaining member 32, whereas the two side rails 124 extend to the two inclined shoulders 38 then down to the bottom edge 36. It is noted that the two inclined shoulders 38 each has a curved top surface 39 for unique fitting with the inner surface of the shoulder portion of an aquatic sport suit such as a wetsuit or a drysuit. By way of example only, the height of the first vertical panel 12, which is the distance between its top end 34 and its bottom edge 36, is approximately $4\frac{3}{4}$ inches, the width of the bottom edge 36 is approximately 18 inches, and the thickness of the first vertical panel 12, which includes the height of the two side rails 124 of the U-shaped channel structure, is approximately 1 inch.

The second vertical panel 14 of multiple plane hanger frame 10 has a central vertical member 42 which has an upper end 44 and a lower end 46. The upper end 44 of the central vertical beam 42 is integrally formed with and connected to the second end of the horizontal bridge member 16, where the generally U-shaped channel structure extends from the horizontal bridge member 16 to the central vertical beam 42. This channel structure extends throughout the various members of the second vertical panel 14. By way of example only, the length of the central vertical member 42, which is the distance between its upper end 44 and its lower end 46, is approximately $13\frac{1}{4}$ inches, the width of the central vertical member 42 is approximately 2 inches, and the thickness of the central vertical member 42, which includes the height of the two side rails 124 of the U-shaped channel structure, is approximately $\frac{3}{4}$ inch. This thickness is uniform throughout the second vertical panel 14. It is noted that this thickness is smaller than the thickness of the first vertical panel 12. However, the thicknesses of the flat bottom 122 and the two side rails 124 of the U-shaped channel structure of the second vertical panel 14 is the same as those of the U-shaped channel structure of the first vertical panel 12, which are all approximately ¼ inches.

The lower end 46 of the central vertical member 42 is integrally formed with and connected to the center 58 of a lower horizontal member 52, such that the central vertical member 42 and the lower horizontal member 52 together form a generally reversed T-shaped central support structure 18. The lower horizontal member 52 has a first lateral end 54 and a second lateral end 56. The length of the lower horizontal member 52, which is the distance between its first lateral end 54 and its second lateral end 56 measured along its horizontal bottom edge, is approximately 12 inches, and the width of the lower horizontal member 52 is approximately 2 inches.

The second vertical panel 14 of multiple plane hanger frame 10 also comprises two aquatic sport boot retaining members 62 and 72. The first aquatic sport boot retaining member 62 is generally reversed L-shaped having a lower vertical portion 64 and an upper inclined portion 66. The lower vertical portion 64 of the first aquatic sport boot retaining member 62 is integrally formed with and extends from the lower horizontal member 52 of the reversed T-shaped central support structure 18 at a location between the center 58 and the first lateral end 54 of the lower horizontal member 52, and is generally parallel to the central vertical member 42 of the reversed T-shaped central support structure 18. The upper inclined portion 66 of the first aquatic sport boot retaining member 62 extends upwardly and outwardly away from the central vertical member 42. The width of the lower vertical portion 64 of the first aquatic sport boot retaining member 62 is tapered towards the joint 68 with the upper inclined portion 66 for easy placement and removal of an aquatic sport aquatic sport boot. By way of example only, the widest width of the lower vertical portion 64 of the first aquatic sport boot retaining member 62 is approximately 3 inches, the width at the joint 68 of the first aquatic sport boot retaining member 62 is approximately 1½ inches, and the width of the upper inclined portion 66 of the first aquatic sport boot retaining member 62 is also approximately 1½ inches. In addition, the length of the lower vertical portion 64 of the first aquatic sport boot retaining member 62 measured along its vertical inner edge, is approximately 8 inches, the length of the upper inclined portion 66 of the first aquatic sport boot retaining member 62 measured from its tip to the joint 68, is approximately 4 inches, and the tilted angle of the upper inclined portion 66, which is the angle between the upper inclined portion 66 and the horizontal direction, is approximately 34 degrees. The clearance between the lower vertical portion 64 of the first aquatic sport boot retaining member 62 and the central vertical member 42 of the reversed T-shaped central support structure 18 is approximately ¾ inch.

The second aquatic sport boot retaining member 72 is an exact mirror-image of the first aquatic sport boot retaining member 62. The second aquatic sport boot retaining member 72 is also generally reversed L-shaped having a lower vertical portion 74 and an upper inclined portion 76. The lower vertical portion 74 of the second aquatic sport boot retaining member 72 is integrally formed with and extends from the lower horizontal member 52 of the reversed T-shaped central support structure 18 at a location between the center 58 and the second lateral end 56 of the lower horizontal member 52, and is generally parallel to the central vertical member 42 of the reversed T-shaped central support structure 18, such that it is on the opposite side of the central vertical member 42 as compared to the first aquatic sport boot retaining member 62. The upper inclined portion 76 of the second aquatic sport boot retaining member 72 also extends upwardly and outwardly away from the central vertical member 42. The width of the lower vertical portion 74 of the second aquatic sport boot retaining member 72 is tapered towards the joint 78 with the upper inclined portion 76 for easy placement and removal of an aquatic sport boot. By way of example only, the widest width of the lower vertical portion 74 of the second aquatic sport boot retaining member 72 is approximately 3 inches, the width at the joint 78 of the second aquatic sport boot retaining member 72 is approximately 1½ inches, and the width of the upper inclined portion 76 of the second aquatic sport boot retaining member 72 is also approximately 1½ inches. In addition, the length of the lower vertical portion 74 of the second aquatic sport boot retaining member 72 measured along its vertical inner egde, is approximately 8 inches, the length of the upper inclined portion 76 of the second aquatic sport boot retaining member 72 measured from its tip to the joint 78, is approximately 4 inches, and the tilted angle of the upper inclined portion 76, which is the angle between the upper inclined portion 76 and the horizontal direction, is also approximately 34 degrees. The clearance between the lower vertical portion 74 of the second aquatic sport boot retaining member 72 and the central vertical member 42 of the reversed T-shaped central support structure 18 is approximately ¾ inch.

The second vertical panel 14 of multiple plane hanger frame 10 further comprises two aquatic sport glove retaining members 82 and 92. The first aquatic sport glove retaining member 82 has a lower end 84 and an upper end 86. The lower end 84 of the first aquatic sport glove retaining member 82 is integrally connected with the first lateral end 54 of the lower horizontal member 52 of the reversed T-shaped central supporting structure 18. The first aquatic sport glove retaining member 82 extends upwardly and outwardly from the first lateral end 54 of the lower horizontal member 52 of the reversed T-shaped central supporting structure 18. By way of example only, the length of the first aquatic sport glove retaining member 82, which is the distance between its lower end 84 and its upper end 86, is approximately 6½ inches, the width of the first aquatic sport glove retaining member 82 is approximately ¾ inch, and the tilted angle of the first aquatic sport glove retaining member 82, which is the angle between the first aquatic sport glove retaining member 82 and the horizontal direction, is approximately 57 degrees.

The second aquatic sport glove retaining member 92 is an exact mirror-image of the first aquatic sport glove retaining member 82. The second aquatic sport glove retaining member 92 also has a lower end 94 and an upper end 96. The lower end 94 of the second aquatic sport glove retaining member 92 is integrally connected with the second lateral end 56 of the lower horizontal member 52 of the reversed T-shaped central supporting structure 18. The second aquatic sport glove retaining member 92 extends upwardly and outwardly from the second lateral end 56 of the lower horizontal member 52 of the reversed T-shaped central supporting structure 18. By way of example only, the length of the second aquatic sport glove retaining member 92, which is the distance between its lower end 94 and its upper end 96, is approximately 6½ inches, the width of the second aquatic sport glove retaining member 92 is approximately ¾ inch, and the tilted angle of the second aquatic sport glove retaining member 92, which is the angle between the second aquatic sport glove retaining member 92 and the horizontal direction, is approximately 57 degrees.

In addition, the second vertical panel 14 of multiple plane hanger frame 10 comprises an aquatic sport utility article retaining member 102. The aquatic sport utility article retaining member 102 has a connecting end 104 and a suspended end 106. The connecting end 104 of the aquatic sport utility article retaining member 102 is integrally formed with and connected to the second lateral end 56 of the lower horizontal member 52 of the reversed T-shaped central supporting structure 18. The aquatic sport utility article retaining member 102 is then backwardly extended below the lower horizontal member 52 towards the first lateral end 54 of the lower horizontal member 52, such that the suspending end 106 of the aquatic sport utility article retaining member 102 is proximately located under the first lateral end 54 of the lower horizontal member 52, and a horizontal slot or recess 108 is formed between the lower horizontal member 52 of the reversed T-shaped central supporting structure 18 and the aquatic sport utility article retaining member 102 for retaining aquatic sport utility articles such as a hood, a mask, fins, towels and other accessories. The suspended end 106 of the aquatic sport utility article retaining member 102 may be widened for preventing an aquatic sport utility article from dropping off the aquatic sport utility article retaining member 102. By way of example only, the length of the aquatic sport utility article retaining member 102, which is the distance between its connecting end 104 and its suspended end 106, is approximately 8½ inches, the width of the aquatic sport utility article retaining member 102 is approximately ¾ inch, and the clearance between the lower horizontal member 52 and the aquatic sport utility article retaining member 102 is approximately ¾ inch.

Referring to FIGS. 7 through 9, the detachable swivel hook 8 of the present invention specialized aquatic gear hanger 6 comprises an upper hook member 112 and a lower shank member 113. The upper hook member 112 has a generally question mark "?" shape. It also has an "I"-shaped cross-section, which has a central stem 132 and two end flanges 134. The upper hook member 112 serves as a regular hook. By way of example only, the width of the central stem 132 is approximately ¾ inch, the thickness of the central stem 132 is approximately ¼ inch, the width of the end flanges 134 is approximately ¾ inch, and the thicknesses of the end flanges 134 is approximately ⅛ inch.

The lower shank member 113 of the detachable swivel hook 8 is designed to be inserted into the central aperture 26 of the horizontal bridge member 16 of the multiple plane hanger frame 10. A circular flange 114 is provided at the junction between the upper hook member 112 and the lower shank member 113 of the detachable swivel hook 8. The lower shank member 113 comprises a central shaft 116 and two oppositely disposed thin pieces 118 splitting from the central shaft 116. Each thin piece 118 is flexible and collapsible towards the central shaft 116 upon insertion into the central aperture 26 of the horizontal bridge member 16. At the bottom end of each thin piece 118 there is an outwardly extended claw 119. When the central shaft 116 and the two thin pieces 118 are fully inserted into the central aperture 26 of the horizontal bridge member 16, the circular flange 114 will rest against the upper circular rim 27 of the cylindrical sidewall 28 of the horizontal bridge member 16 for stopping the lower shank member 113 from further sliding down within the central aperture 26 of the horizontal bridge member 16, and the two respective claws 119 of the two thin pieces 118 are propped outwardly and engage with the lower circular rim 29 of the cylindrical sidewall 28 of the horizontal bridge member 16 for stopping the lower shank member 113 from sliding up and out off the central aperture 26 of the horizontal bridge member 16. The central shaft 116 will act to prevent shank member 113 of the hook 8 from trembling about the horizontal bridge member 16 of the multiple plane hanger frame 10. The hook 8 and the multiple plane hanger frame 10 are free to rotate relative to each other. In addition, the hook 8 may be removed from the multiple plane hanger frame 10 by simply pressing the two claws 119 of the two thin pieces 118 inwardly and pull the shank member 113 of the hook 8 out of the central aperture 26 of the horizontal bridge member 16 of the multiple plane hanger frame 10.

As shown in FIG. 10, the present invention specialized aquatic gear hanger 6 is used to hang a complete set of aquatic sport gear. The hook 8 is hung over a horizontal beam 142. An aquatic sport suit such as a wetsuit 152 is retained by the first vertical panel 12. Two aquatic sport booties 154 are retained upside-down by the two aquatic sport boot retaining members 62 and 72 respectively. It is noted that the sole portions of the aquatic sport booties 154 rest on the upper tilted portions of the two aquatic sport boot retaining members 62 and 72, and the elongated neck portions of the aquatic sport booties 154 are naturally positioned in a straight orientation. The upper tilted portions of the two aquatic sport boot retaining members 62 and 72 extend outwardly, which makes it much easier to place the aquatic sport booties 154 on or remove them from the two aquatic sport boot retaining members 62 and 72. The clearances between the central vertical member 42 and the two aquatic sport boot retaining members 62 and 72 are sufficient for the thickness of the neck portions of the aquatic sport booties 154. Two aquatic sport gloves 156 are retained upside-down by the two aquatic sport glove retaining members 82 and 92 respectively. Finally, an aquatic sport utility article such as a hood 158 is retained by the aquatic sport utility article retaining member 102, where the clearance between the lower horizontal member 52 and the aquatic sport utility article retaining member 102 is sufficient to allow sliding the aquatic sport utility article such as a hood 158 all the way into the horizontal slot or recess therebetween. The multiple plane hanger frame 10 is rotatable relative to the hook 8 to readily fit in any hanging space.

The present invention specialized aquatic gear hanger is preferably made of molded polypropylene material. The present invention specialized aquatic gear hanger is highly resistant to corrosion and abrasion, non-absorptive to water and non-harmful to the environment. It has minimal weight, but is very strong and durable. All surfaces of the specialized aquatic gear hanger are to be finely finished and all sharp edges and corners are to be rounded and smooth.

The generally U-shaped channel structure of the multiple plane hanger frame of the present invention specialized aquatic gear hanger provides a very strong and sturdy construction, which can withstand the heavy weight of the wetted aquatic sport suit and all the other aquatic gear accessories together. The generally U-shaped channel structure of all accessory retaining members of the second vertical panel of the specialized hanger particularly reinforce the strength of the accessory retaining members in all lateral directions.

The advanced design and arrangement of the various accessory retaining members of the second vertical panel of the hanger is very practical and highly efficient in actual applications. It hangs a whole aquatic sport gear set together in a small space and the orientation of the hanger can be adjusted to the allowed hanging space. The present invention specialized aquatic gear hanger may be used not only for hanging and drying an aquatic sport gear set in a private household, but also for displaying, exhibiting and storing the aquatic sport gear sets in sporting goods stores. In addition, the present invention specialized hanger may be used for hanging a complete set of other similar types of sports gears. The essential feature of the present invention hanger is that it retains a complete set of sports gear all on one hanger.

Defined in detail, the present invention is a specialized aquatic sport suit and accessories hanger, comprising: (a) a detachable swivel hook detachably and rotatably attached to a unitary multiple plane hanger frame; (b) said unitary multiple plane hanger frame having a first vertical panel and a second vertical panel interconnected by a horizontal bridge member, such that the first and second vertical panels are parallel to and spaced apart from each other; (c) said horizontal bridge member having a first end, a second end and a central vertical aperture between its first and second ends; (d) said first vertical panel integrally connected to said first end of said horizontal bridge member and having a generally triangular shaped configuration for retaining an aquatic sport suit; (e) said second vertical panel having a vertical member and a horizontal member, the vertical member further comprising an upper end integrally connected to said second end of said horizontal bridge member and a lower end integrally connected to the horizontal member, and the horizontal member further comprising a first lateral end and a second lateral end; (f) said second vertical panel further comprising a first aquatic sport glove retaining member and a second aquatic sport glove retaining member, the first aquatic sport glove retaining member integrally connected to said first lateral end of said horizontal member and extending upwardly and laterally and laterally away from said vertical member, and the second aquatic sport glove retaining member integrally connected to said second lateral end of said horizontal member and extending upwardly and laterally away from said vertical member; (g) said second vertical panel further comprising a first aquatic sport boot retaining member and a second aquatic sport boot retaining member each having a lower portion extending upwardly and parallel to said vertical member and an upper portion extending upwardly and laterally away from said vertical member, the first aquatic sport boot retaining member integrally connected to said horizontal member between said first aquatic sport glove retaining member and said vertical member, and the second aquatic sport boot retaining member integrally connected to said horizontal member between said second aquatic sport glove retaining member and said vertical member; (h) said second vertical member also having an aquatic sport utility article retaining member integrally connected to said second lateral end of said horizontal member and extending toward said first lateral end of said horizontal member, the aquatic sport utility article retaining member being parallel to and spaced apart from said horizontal member; (i) said hook having a hook portion and a shank member, the shank member being engageable with said central vertical aperture of said horizontal bridge member of said unitary multiple plane hanger frame, the shank member further comprising means for detachably and rotatably securing said shank member to said horizontal bridge member of said unitary multiple plane hanger frame; and (j) said means for detachably and rotatably securing said shank member to said horizontal bridge member of said unitary multiple plane hanger frame including an upper circular flange, a central shaft and two flexible thin pieces positioned on opposite sides of the central shaft, each flexible thin piece having a lower bottom flange extended outwardly, whereby when the central shaft and two flexible thin pieces are inserted into said central aperture of said horizontal bridge member, the upper circular flange and the lower bottom flange of each flexible thin piece will prevent said shank member of said hook from sliding out of said central aperture of said horizontal bridge member.

Defined broadly, the present invention is a specialized aquatic sport gear hanger, comprising: (a) a detachable swivel hook detachably and rotatably attached to a unitary multiple plane hanger frame; (b) said unitary multiple plane hanger frame having a first vertical panel and a second vertical panel interconnected by a horizontal bridge member, such that the first and second vertical panels are parallel to and spaced apart from each other; (c) said horizontal bridge member having a first end, a second end and a central vertical aperture between its first and second ends; (d) said first vertical panel integrally connected to said first end of said horizontal bridge member and having a generally triangular shaped configuration for retaining an aquatic sport suit; (e) said second vertical panel having a vertical member and a horizontal member, the vertical member further comprising an upper end integrally connected to said second end of said horizontal bridge member and a lower end integrally connected to the horizontal member, and the horizontal member further comprising a first lateral end and a second lateral end; (f) said second vertical panel further comprising a first aquatic sport glove retaining member and a second aquatic sport glove retaining member, the first aquatic sport glove retaining member integrally connected to said first lateral end of said horizontal member and extending upwardly and laterally and laterally away from said vertical member, and the second aquatic sport glove retaining member integrally connected to said second lateral end of said horizontal member and extending upwardly and laterally away from said vertical member; (g) said second vertical panel further comprising a first aquatic sport boot retaining member and a second aquatic sport boot retaining member each having a lower portion extending upwardly and parallel to said vertical member and an upper portion extending upwardly and laterally away from said vertical member, the first aquatic sport boot retaining member integrally connected to said horizontal member between said first aquatic sport glove retaining member and said vertical member, and the second aquatic sport boot retaining member integrally connected to said horizontal member between said second aquatic sport glove retaining member and said vertical member; (h) said second vertical member also having an aquatic sport utility article retaining member integrally connected to said second lateral end of said horizontal member and extending toward said first lateral end of said horizontal member, the aquatic sport utility article retaining member being parallel to and spaced apart from said horizontal member; and (i) said hook having hook portion and a shank member, the shank member being engageable with said central vertical aperture of said horizontal bridge member of said unitary multiple plane hanger frame, the shank member further comprising means for detachably and rotatably securing said shank member to said horizontal bridge member of said unitary multiple plane hanger frame.

Defined more broadly, the present invention is a specialized sports gear hanger, comprising: (a) a multiple plane hanger frame having a first vertical panel and a second vertical panel interconnected by a horizontal bridge member, such that the first and second vertical panels are spaced apart from each other; (b) said first vertical panel having a generally triangular shaped configuration for retaining a sport suit; (c) said second vertical panel having a reversed T-shaped central structure which has an upper vertical portion and a lower horizontal portion with two lateral ends; (d) said second vertical panel further comprising two sport glove retaining members respectively connected to and upwardly and outwardly extending from said two lateral ends of said lower horizontal portion of said reversed T-shaped central structure; (e) said second vertical panel further comprising two reversed L-shaped sport boot retaining members respectively positioned next to but on opposite sides of said upper vertical portion of said reversed T-shaped central structure, each reversed L-shaped sport boot retaining member having a lower portion connected to and extending upwardly from said lower horizontal portion of said reversed T-shaped central structure and an upper portion extending upwardly and outwardly away from said upper vertical portion of said reversed T-shaped central structure; and (f) said second vertical member also having a sport utility article retaining member connected to and positioned spaced apart from said lower horizontal portion of said reversed T-shaped central structure.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A specialized aquatic sport suit and accessories hanger for hanging up and dripping dry a heavy aquatic sport suit together with aquatic sport accessories including a pair of aquatic sport boots, a pair of aquatic sport gloves and other small aquatic sport utility articles, all in spaced apart relationship, comprising:

a. a detachable swivel hook detachably and rotatably attached to a unitary multiple plane hanger frame;

b. said unitary multiple plane hanger frame having a first vertical panel and a second vertical panel interconnected by a horizontally extended bridge member, such that the first and second vertical panels are parallel to and spaced apart from each other, the distance between said parallel first and second vertical panels being approximately $2\frac{1}{2}$ inches;

c. said horizontal bridge member having a first end, a second end and a central vertical aperture between its first and second ends for accommodating said hook along a central vertical line between said first and second parallel vertical panels to keep said hanger balanced once both said first and second parallel vertical panels are fully loaded respectively with said aquatic sport suit and accessories;

d. said first vertical panel integrally connected to said first end of said horizontal bridge member and having a generally triangular shaped configuration for retaining an aquatic sport suit;

e. said second vertical panel having a vertical member and a horizontal member, the vertical member further comprising an upper end integrally connected to said second end of said horizontal bridge member and a lower end integrally connected to the horizontal member, and the horizontal member further comprising a first lateral end and a second lateral end;

f. said second vertical panel further comprising a first aquatic sport glove retaining member and a second aquatic sport glove retaining member, the first aquatic sport glove retaining member integrally connected to said first lateral end of said horizontal member and extending upwardly and laterally away from said vertical member, and the second aquatic sport glove retaining member integrally connected to said second lateral end of said horizontal member and extending upwardly and laterally away from said vertical member;

g. said second vertical panel further comprising a first aquatic sport boot retaining member and a second aquatic sport boot retaining member each having a lower portion extending upwardly and parallel to said vertical member and an upper portion extending upwardly and laterally away from said vertical member, the first aquatic sport boot retaining member integrally connected to said horizontal member between said first aquatic sport glove retaining member and said vertical member, and the second aquatic sport boot retaining member integrally connected to said horizontal member between said second aquatic sport glove retaining member and said vertical member, the first and second aquatic sport boot retaining members being able to hold said pair of aquatic sport boots in an upside-down and outwardly pointing position for easy and non-crimpled placement or removal of said pair of aquatic sport boots;

h. said second vertical member also having an aquatic sport utility article retaining member integrally connected to said second lateral end of said horizontal member and extending toward said first lateral end of said horizontal member, the aquatic sport utility article retaining member being parallel to and spaced apart from said horizontal member;

i. said hook having a hook portion and a shank member, the shank member being engageable with said central vertical aperture of said horizontal bridge member of said unitary multiple plane hanger frame, the shank member further comprising means for detachably and rotatably securing said shank member to said horizontal bridge member of said unitary multiple plane hanger frame; and j. said means for detachably and rotatably securing said shank member to said horizontal bridge member of said unitary multiple plane hanger frame including an upper circular flange, a central shaft and two flexible thin pieces positioned on opposite sides of the central shaft, the central shaft being substantially thicker than said two flexible thin means for preventing said shank member of said hook member from trembling about said horizontal bridge member of said unitary multiple plane hanger frame, each flexible thin piece having a lower bottom flange extended outwardly, whereby when the central shaft and two flexible thin pieces are inserted into said central aperture of said horizontal bridge member, the upper circular flange and the lower bottom flange of each flexible thin piece will prevent said shank member of said hook from sliding out of said central aperture of said horizontal bridge member.

2. The invention as defined in claim 1 wherein said vertical member, said horizontal member, said first and second aquatic sport glove retaining members, said first and second aquatic sport boot retaining members and said aquatic sport utility article retaining member of said second vertical panel are all aligned in a same plane.

3. The invention as defined in claim 1 wherein said unitary multiple plane hanger frame is integrally made of a non-absorptive and noncorrosive durable material.

4. The invention as defined in claim 3 wherein said non-absorptive and noncorrosive durable material is plastic.

5. The invention as defined in claim 4 wherein said plastic is polypropylene.

6. The invention as defined in claim 1 wherein said unitary multiple plane hanger frame has a continuous U-shaped channel structure.

7. The invention as defined in claim 1 wherein said detachable swivel hook is made of a non-absorptive and noncorrosive durable material.

8. The invention as defined in claim 7 wherein said non-absorptive and noncorrosive durable material is plastic.

9. The invention as defined in claim 8 wherein said plastic is polypropylene.

10. The invention as defined in claim 1 wherein said hook portion of said hook has a continuous I-shaped cross-sectional structure.

11. A specialized aquatic sport gear hanger for hanging and drying a heavy aquatic sport suit together with aquatic sport accessories including a pair of aquatic sport boots, a pair of aquatic sport gloves and other small aquatic sport utility articles, all in spaced apart relationship, comprising:

a. a detachable swivel hook detachably and rotatably attached to a unitary multiple plane hanger frame;

b. said unitary multiple plane hanger frame having a first vertical panel and a second vertical panel interconnected by a horizontally extended bridge member, such that the first and second vertical panels are parallel to and spaced apart from each other to maintain a fixed distance therebetween;

c. said horizontal bridge member having a first end, a second end and a central vertical aperture between its first and second ends for accommodating said hook along a vertical line between said first and second parallel vertical panels to keep said hanger balanced once both said first and second parallel vertical panels are fully loaded respectively with said aquatic sport suit and accessories;

d. said first vertical panel integrally connected to said first end of said horizontal bridge member and having a generally triangular shaped configuration for retaining an aquatic sport suit;

e. said second vertical panel having a vertical member and a horizontal member, the vertical member further comprising an upper end integrally connected to said second end of said horizontal bridge member and a lower end integrally connected to the horizontal member, and the horizontal member further comprising a first lateral end and a second lateral end;

f. said second vertical panel further comprising a first aquatic sport glove retaining member and a second aquatic sport glove retaining member, the first aquatic sport glove retaining member integrally connected to said first lateral end of said horizontal member and extending upwardly and laterally away from said vertical member, and the second aquatic sport glove retaining member integrally connected to said second lateral end of said horizontal member and extending upwardly and laterally away from said vertical member;

g. said second vertical panel further comprising a first aquatic sport boot retaining member and a second aquatic sport boot retaining member each having a lower portion extending upwardly and parallel to said vertical member and an upper portion extending upwardly and laterally away from said vertical member, the first aquatic sport boot retaining member integrally connected to said horizontal member between said first aquatic sport glove retaining member and said vertical member, and the second aquatic sport boot retaining member integrally connected to said horizontal member between said second aquatic sport glove retaining member and said vertical member, the first and second aquatic sport boot retaining members being able to hold said pair of aquatic sport boots in an upside-down and outwardly pointing position for easy and non-crimpled placement or removal of said pair of aquatic sport boots;

h. said second vertical member also having an aquatic sport utility article retaining member integrally connected to said second lateral end of said horizontal member and extending toward said first lateral end of said horizontal member, the aquatic sport utility article retaining member being parallel to and spaced apart from said horizontal member; and i. said hook having a hook portion and a shank member, the shank member being engageable with said central vertical aperture of said horizontal bridge member of said unitary multiple plane hanger frame, the shank member further comprising means for detachably and rotatably securing said shank member to said horizontal bridge member of said unitary multiple plane hanger frame.

12. The invention as defined in claim 11 wherein said unitary multiple plane hanger frame is integrally made of a non-absorptive and noncorrosive durable material.

13. The invention as defined in claim 12 wherein said non-absorptive and noncorrosive durable material is plastic.

14. The invention as defined in claim 13 wherein said plastic is polypropylene.

15. The invention as defined in claim 11 wherein said unitary multiple plane hanger frame has a continuous channel structure.

16. The invention as defined in claim 11 wherein said detachable swivel hook is made of a non-absorptive and noncorrosive durable material.

17. The invention as defined in claim 16 wherein said non-absorptive and noncorrosive durable material is plastic.

18. The invention as defined in claim 17 wherein said plastic is polypropylene.

19. The invention as defined in claim 11 wherein said means for detachably and rotatably securing said shank member to said horizontal bridge member of said unitary multiple plane hanger frame includes an upper circular flange, a central shaft and two flexible thin pieces positioned on opposite sides of the central shaft, the central shaft being substantially thicker than said two flexible thin means for preventing said shank member of said hook member from trembling about said horizontal bridge member of said unitary multiple plane hanger frame, each flexible thin piece having a lower bottom flange extended outwardly, whereby when the central shaft and two flexible thin pieces are inserted into said central aperture of said horizontal bridge member, the upper circular flange and the lower bottom flange of each flexible thin piece will prevent said shank member of said hook from sliding out of said central aperture of said horizontal bridge member.

20. A specialized sports gear hanger for hanging a heavy sport suit together with aquatic sport accessories including a pair of sport boots, a pair of sport gloves and other small sport utility articles, all in spaced apart relationship, comprising:

a. a multiple plane hanger frame having a first vertical panel and a second vertical panel interconnected by a horizontally extended bridge member, such that the first and second vertical panels are spaced apart from each other to maintain a proper distance therebetween;

b. said first vertical panel having a generally triangular shaped configuration for retaining a sport suit;

c. said second vertical panel having a reversed T-shaped central structure which has an upper vertical portion and a lower horizontal portion with two lateral ends;

d. said second vertical panel further comprising two sport glove retaining members respectively connected to and upwardly and outwardly extending from said two lateral ends of said lower horizontal portion of said reversed T-shaped central structure;

e. said second vertical panel further comprising two reversed L-shaped sport boot retaining members respectively positioned next to but on opposite sides of said upper vertical portion of said reversed T-shaped central structure, each reversed L-shaped sport boot retaining member having a lower portion connected to and extending upwardly from said lower horizontal portion of said reversed T-shaped central structure and an upper portion extending upwardly and outwardly away from said upper vertical portion of said reversed T-shaped central structure, the first and second L-shaped sport boot retaining members being able to hold said pair of aquatic sport boots in an upside-down and outwardly pointing position for easy and non-crimpled placement or removal of said pair of aquatic sport boots; and f. said second vertical member also having a sport utility article retaining member connected to and positioned spaced apart from said lower horizontal portion of said reversed T-shaped central structure.

21. The invention as defined in claim 20 wherein said unitary multiple plane hanger frame is integrally made of a non-absorptive and noncorrosive durable material.

22. The invention as defined in claim 21 wherein said non-absorptive and noncorrosive durable material is plastic.

23. The invention as defined in claim 22 wherein said plastic is polypropylene.

24. The invention as defined in claim 20 wherein said unitary multiple plane hanger frame has a continuous channel structure.

25. The invention as defined in claim 20 further comprising a hook member.

26. The invention as defined in claim 25 wherein said hook member is detachably and rotatably attached to said bridge member of said multiple plane hanger frame along a vertical line between said first and second parallel vertical panels to keep said hanger balanced once both said first and second parallel vertical panels are fully loaded respectively with said sport suit and accessories.

27. The invention as defined in claim 25 wherein said hook member is integrally made of a non-absorptive and noncorrosive durable material.

* * * * *